United States Patent [19]

Schiemichen

[11] 3,962,877

[45] June 15, 1976

[54] OFF-SHORE POWER PLANT

[75] Inventor: Peter Schiemichen, Hunxe, Germany

[73] Assignee: Deutsche Babcock & Wilcox Aktiengesellschaft, Oberhausen, Germany

[22] Filed: Mar. 6, 1975

[21] Appl. No.: 555,898

[30] Foreign Application Priority Data

Mar. 16, 1974 Germany ..... 2412662

[52] U.S. Cl. ..... 61/46.5; 60/39.18 B; 114/.5 R

[51] Int. Cl.[2] ..... F02C 7/08; E02B 17/00; B63B 35/02

[58] Field of Search ..... 61/46.5, 46; 114/.5; 60/39.18 B, 39.24

[56] References Cited

UNITED STATES PATENTS

| | | | |
|---|---|---|---|
| 3,161,492 | 12/1964 | Keith et al. | 61/46.5 X |
| 3,599,589 | 8/1971 | Busey | 114/.5 R |
| 3,703,807 | 11/1972 | Rice | 60/39.18 B |
| 3,765,167 | 10/1973 | Rudolph et al. | 60/39.18 B |
| 3,837,308 | 9/1974 | Harvey et al. | 114/.5 R |

OTHER PUBLICATIONS

Gas Turbine World, May 1973, pp. 16–17.

*Primary Examiner*—Jacob Shapiro
*Attorney, Agent, or Firm*—Max Fogiel

[57] ABSTRACT

An off-shore power plant in which the steam generators of the power plant are located within the support structure carrying the components of the power plant. The steam generator is operated with superpressure in the combustion chamber. A gas turbine is connected to the flue gas smoke stack of the combustion chamber, and a steam turbine is connected to the steam duct of the chamber. The support structure holding the steam generator carries a platform with several decks. The water treatment and gas purification equipment is located on the lower deck, whereas the upper deck carries the turbines and the generators.

9 Claims, 2 Drawing Figures

OFF-SHORE POWER PLANT

BACKGROUND OF THE INVENTION

The present invention relates to off-shore power plants which are erected in coastal regions or in the open sea and float or are supported on the ocean bottom. It is the object of the present invention to erect such power plants with a high degree of efficiency and minimum construction volume.

It is already known in the art, how to construct an off-shore power plant at the production locations of the fields and, instead of transporting the produced natural gas to the mainland, to convert it into electric power directly at the well head. The natural gas was to be burnt in a series of gas turbines operating in a compound arrangement. The efficiency of pure gas turbines, however, is small. A compound arrangement of such gas turbines also requires a large platform so that the power output per unit area is low.

Because of the high construction cost for the support structures, minimum construction volume is desired for off-shore power plants.

It is, therefore, an object of the present invention to provide an off-shore power plant which meets this requirement.

Another object of the present invention is to provide an off-shore power plant which may be economically fabricated and readily serviced for maintenance.

A further object of the present invention is to provide an off-shore power plant of the foregoing character, which is constructed to have a substantially long operating life.

Summary of the Invention

The objects of the present invention are achieved as follows. The steam generators of the power plant are located inside the support structure carrying the series-connected aggregates. With such a power plant, the construction volume can be reduced by placing part of the power plant inside the support structure which is already there.

Such a combination is possible if steam generators are used which are operated with superpressure in the combustion chamber and to whose flue gas duct a gas turbine is connected. Furthermore, a steam turbine is connected to its steam duct. Hence one uses a combined steam-gas process with super-charged boilers. Such super-charged boilers have a cylindrical shape and are well suited for location in the support structure. In addition, the combined gas-steam process results in improved efficiency which results in a higher power output per unit area.

In furtherance of the present invention, this low construction volume makes possible an advantageous type of installation. In accordance with the present invention, the decks are made floatable and equipped at the rigging yard with all thermodynamic and mechanical equipment. Decks equipped in that fashion can be towed as complete units across the water to their destination. The assembly takes place at the rigging yard, and the expensive assembly at sea is reduced to a minimum.

The novel features which are considered as characteristic for the invention are set forth in particular in the appended claims. The invention itself, however, both as to its construction and method of operation, together with additional objects and advantages thereof, will be best understood from the following description of specific embodiments when read in connection with the accompanying drawings.

DESCRIPTION OF THE PREFERRED EMBODIMENT

In accordance with the present invention, the off-shore power plant is designed for operation with natural gas. Petroleum may also be used. A weak gas with a high nitrogen content is particularly well suited.

Figure 1:
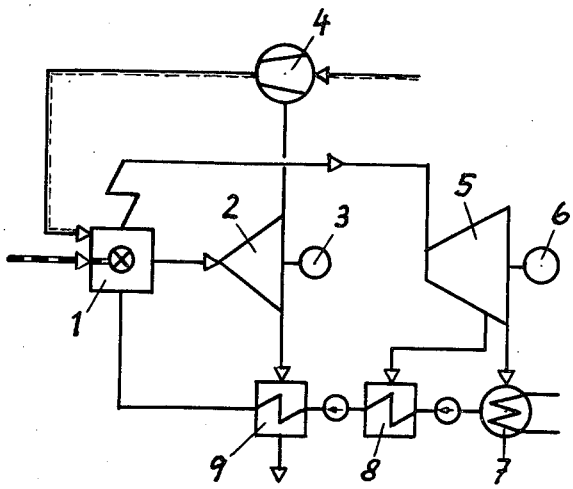
FIG. 1 is a schematic view and shows the gas-vapor cycle.

In accordance with FIG. 1, the natural gas produced is delivered to a steam generator in whose combustion chamber it is burned at superpressure with the addition of compressed air for combustion. Part of the generated heat is used for steam generation. The remainder of the heat is delivered to a gas turbine 2 to which the hot flue gases are delivered. Gas turbine 2 drives a generator 3. A compressor 4 for compressing the air of combustion is coupled to gas turbine 2.

The generated steam is delivered to a steam turbine 5 which drives a generator 6. After performing work, the steam arrives at a condenser 7 cooled with ocean water. The condensate is preheated in a steam-heated feedwater preheater 8 and a flue-gas heated feedwater preheater 9, and then returned to steam generator 1.

If the pressure of the produced natural gas is high enough, a flashing turbine may be provided to which the natural gas is delivered. This flashing turbine then can drive the compressor 4 for compressing the air for combustion.

Figure 2:
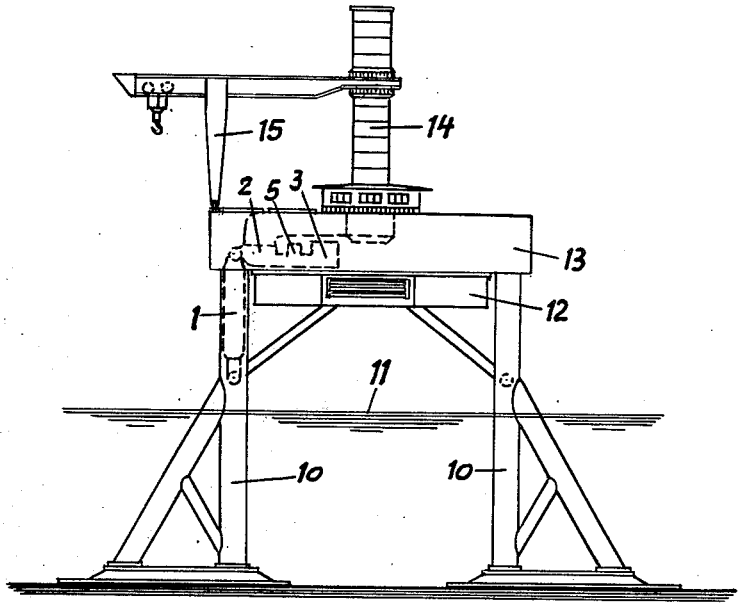
FIG. 2 is an elevational view and shows the power plant of the present invention.

In accordance with the arrangement of FIG. 2, the power plant is located on an ocean platform. The latter comprises the legs 3 arranged in a triangle, which carry a platform. The legs 3 are supported by the ocean bottom. Line 11 indicates the water level. The legs 10 accommodate a steam generator 1 which has the form of a charged boiler. The natural gas and the air for combustion are introduced to the lower section of this standing boiler 1. The steam and the flue gas are delivered to the turbines from the upper section of the boiler. In contrast with the combination processes customary on land, this arrangement has special thermodynamic advantages.

The platform comprises several decks on top of one another: the lower deck 12, the gas purification, the water preparation aggregates, and all equipment necessary to supply the platform. The next higher deck 13 contains the gas turbines 2, the steam turbines 5, and the generators 3 and 6. In FIG. 2 only one gas turbine 2 and the generator 3 connected thereto is shown for purposes of clarity. The aggregates are accessible from above. To this end, deck 13 is equipped with removable installation covers. In addition, deck 13 has a crane runway for a rotary crane 15 rotatable about the central smokestack.

Generators 3 and 6 operate cooperatively in conjunction. The power produced by them is converted into DC current of high voltage. For this, thyristors are available. The DC current is delivered on land via ocean cables.

The power plant described above permits particular easy installation. The necessary individual aggregates can be assembled at the rigging yard directly to the decks or to the support assemblies. The decks are made floatable and can be towed to position. In this way, the expensive assembly at sea is reduced to a minimum. With shallow water depths up to 30 m and smaller units, the support legs are already fastened to the platform and are only lowered at sea. Greater water depths require a trestle-like assembly for each leg. These can be floated to location separately from the platform, are lowered at location, and are there fastened to the mountings of the similarly floating platform decks. During the subsequent assembly at sea, the supporting legs are lowered to the ocean bottom. Thereupon the decks are lifted to their final level above sea level. Now the steel construction assembly of supporting structures and decks takes place. The above-described preassembly in the rigging yard is even possible and advantageous if the steam generators are not located in the support legs, as described, but on one of the decks.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalance of the following claims.

I claim:

1. An off-shore power plant comprising, in combination, support means for carrying the components of said power plant, and having hollow interior chamber means, steam generator means in said support means; combustion chamber means within said interior chamber means of said support means and having flue gas smokestack means and steam duct means, said combustion chamber means being connected to said steam generator means and operated at superpressure; gas turbine means connected to said flue gas smokestack means; steam turbine means connected to said steam duct means; platform means carried by said support means and having a plurality of decks, said gas turbine and said steam turbine means being located on one of said decks.

2. The off-shore power plant as defined in claim 1 wherein said support means has a plurality of supporting legs with hollow interior chamber means for holding said combustion chamber means.

3. The off-shore power plant as defined in claim 11 including water treatment and gas purification means on a lower one of said decks, the upper one of said decks carrying said turbine means and said steam generator means.

4. The off-shore power plant as defined in claim 1 including cover means for covering opening means communicating with said turbine means and said steam generator means, said turbine means and said steam generator means being accessible from above through said opening means.

5. The off-shore power plant as defined in claim 1 indcluding flashing turbine means operable by natural gas at well pressure; and compressor means connected to said flashing turbine means for compressing the air for combustion.

6. The off-shore power plant as defined in claim 3 including thermodynamic and mechanical operating means on said decks for operating said power plant, said decks being floatable.

7. The off-shore power plant as defined in claim 6 including support leg means connected to said decks, said support leg means being lowerable.

8. The off-shore power plant as defined in claim 6 wherein said support leg means are floatable.

9. The off-shore power plant as defined in claim 11 including water treatment and gas purification means carried by a lower one of said decks, the upper one of said decks carrying said turbine means and said steam generator means; cover means for covering an opening communicating with said turbine means and said generator means from above, said turbine means and said generator means being accessible from above through said opening; flashing turbine means operable by natural gas at well pressure; compressor means connected to said flashing turbine means for compressing the air for combustion, said decks being floatable; support leg means connected to said decks, said support leg means being lowerable and floatable; said support means having a plurality of supporting legs with hollow interior chamber means for holding said combustion chamber means; said combustion chamber means having supercharged boilers of cylindrical shape adapted to be held in said support legs, said gas turbine means and steam turbine means cooperating in a gas-steam process having substantially increased power output per unit area, said power plant being substantially assembable onshore and towable to an off-shore location.

* * * * *